US005944368A

United States Patent [19]

Hastings

[11] Patent Number: 5,944,368

[45] Date of Patent: Aug. 31, 1999

[54] DOOR KNOB HOLDING DEVICE

[76] Inventor: Mark S. Hastings, 13145 Madison Ave., Largo, Fla. 33733

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,525

[22] Filed: Jun. 12, 1997

[51] Int. Cl.[6] ..... E05C 17/56

[52] U.S. Cl. ..... 292/251.5; 292/DIG. 19

[58] Field of Search ..... 292/347, 348, 292/336.3, DIG. 2, DIG. 19, 251.5; 24/DIG. 11; 403/205.3

[56] References Cited

U.S. PATENT DOCUMENTS

| | | | |
|---|---|---|---|
| D. 191,784 | 11/1961 | Ingram | D10/7 |
| D. 253,335 | 11/1979 | Gauntner et al. | D8/9 |
| D. 259,395 | 6/1981 | Sugasawara | D8/402 |
| D. 274,980 | 8/1984 | Tomita | D8/402 |
| 2,468,969 | 5/1949 | Galey | 292/1 |
| 2,472,397 | 6/1949 | Bennett | 292/70 |
| 2,496,691 | 2/1950 | Berry | 292/70 |
| 2,497,697 | 2/1950 | Smith | 292/70 |
| 2,519,435 | 8/1950 | Byrd, Jr. | 292/70 |
| 2,521,885 | 9/1950 | Vasquez | 292/251.5 |
| 2,761,718 | 9/1956 | Tool | 292/251.5 |
| 2,815,236 | 12/1957 | Lowinski | 292/251.5 |
| 2,888,289 | 5/1959 | Scott et al. | 292/201 |
| 3,025,559 | 3/1962 | Basinger | 16/85 |
| 3,100,664 | 8/1963 | Duval | 292/251.5 |
| 3,133,758 | 5/1964 | Wells | 292/251.5 |
| 3,163,453 | 12/1964 | Stephens | 292/251.5 |
| 3,204,154 | 8/1965 | Crandell | 317/159 |
| 3,244,443 | 4/1966 | Rodgers | 292/251.5 |
| 3,258,285 | 6/1966 | Smith | 292/251.5 |
| 3,288,511 | 11/1966 | Tavano | 292/251.5 |
| 3,300,239 | 1/1967 | Dinkin | 292/251.5 |
| 3,578,370 | 5/1971 | Greytok | 292/251.5 |
| 3,701,557 | 10/1972 | Centofante | 292/251.5 |
| 3,781,047 | 12/1973 | Surko, Jr. | 292/251.5 |
| 3,791,687 | 2/1974 | Schroeder | 292/251.5 |
| 4,099,755 | 7/1978 | Anderson | 292/251.5 |
| 4,505,502 | 3/1985 | Tomita | 292/347 |
| 4,669,766 | 6/1987 | Hanchett, Jr. et al. | 292/251.5 |
| 4,813,150 | 3/1989 | Colvin | 33/265 |
| 4,852,919 | 8/1989 | Nimee et al. | 292/251.5 |
| 4,995,655 | 2/1991 | Freeman | 292/251.5 |
| 5,010,622 | 4/1991 | Morita | 292/251.5 |
| 5,082,317 | 1/1992 | Delaney, Jr. | 292/251.5 |
| 5,516,387 | 5/1996 | Hoffman | 156/70 |
| 5,592,700 | 1/1997 | Genesse | 4/246.1 |

*Primary Examiner*—Steven Meyers
*Assistant Examiner*—Gary Estremsky
*Attorney, Agent, or Firm*—Joseph C. Mason, Jr.; Dennis G. LaPointe; Mason & Associates, P.A.

[57] ABSTRACT

A door holding device for catching and holding a door in an open position against an adjacent wall is provided. The door has a magnetically attractive door knob mounted thereon. The device comprises a mounting base mounted to the adjacent wall at an elevation substantially equal to the elevation of the door knob. A magnet is secured to the mounting base for coacting with the door knob of the door, wherein upon the door opening from a closed position to a point nearingly adjacent the adjacent wall, the magnet means coacting with the door knob thereby catching the door knob and holding the door in the open position.

15 Claims, 8 Drawing Sheets

DOOR KNOB HOLDING DEVICE

BACKGROUND OF THE INVENTION

1. Field of the Invention

This invention relates generally to magnetic door stops and holders and, more particularly, it relates to magnetic door stops and holders which keep a door open by the magnetic attraction between a door knob and an adjacent mounting plate.

2. Description of the Prior Art

When doors are opened, especially exterior doors with automatic closing mechanisms, the doors are generally closed soon thereafter. However, it is often necessary to keep doors, both interior and exterior, open depending on the situation. It is more practical to keep open the door of a passage where many people come and go and where deliveries are made so as to avoid frequently opening and closing the door each time a person passes through. By keeping such a door open, the door and the adjacent wall upon which the door opens can be protected from damage such as to the hinges of the door as there is applied no load thereon and to the adjacent wall by minimizing the times that the door knob could possibly contact the wall.

Furthermore, many doors are provided with door stops to maintain the door knob from contacting and damaging the adjacent wall. Typical door stops are a flexible coil type mounted near the floor on or adjacent the molding of the adjacent wall and on the door itself. Oftentimes, the flexible coil type and other types of door stops are either damaged or do not sustain the impact of quickly or forcefully opened doors. Once the door stop has been damaged, the adjacent wall of the door also becomes damaged by the force of the door knob of the door against the adjacent wall and must be fixed to maintain the aesthetic beauty and integrity of the adjacent wall.

The use of magnetic door holding devices to stop, catch, and hold doors in a fixed position is generally known in the art. The magnetic door holding devices generally work by (1) mounting a magnet to the door which engages a magnetically attractable strike plate on the adjacent wall or the floor approximate the adjacent wall or (2) mounting a magnetically attractable strike plate to the door which engages a magnet mounted on the adjacent wall or floor approximate the adjacent wall to secure the door in place. Unfortunately, many of these door holding devices are not constructed in such a manner that would inhibit damage to a door or adjacent wall when the door was slammed or otherwise opened quickly. Furthermore, the known door holding devices are not easily mounted to either the door or the adjacent wall and generally require that the integrity of the door and the wall be violated by mounting screws, bolts, or the like during mounting of the door holding device.

U.S. Pat. No. 5,082,317, to Delaney describes a self-adjusting magnetic door stop and catch. The door stop and catch of the Delaney patent has a helically coiled spring mounted on a base board or wall through which a flexible cable extends to hold a swivel mounted magnet at the end of the spring. Attachment of the door stop and catch is accomplished by mounting screws secured into the door and the base board or adjacent wall. Besides increasing the complexity of attaching the door stop and catch, the end result is that driving screws into the door and the base board or adjacent wall destroys the integrity of the door such that removal of the door stop and catch of the Delaney patent from the door and the base board or adjacent wall leaves unsightly holes in the door and the base board or adjacent wall which must be filled or otherwise fixed.

It would be advantageous to provide a door holding device which would allow easy attachment of the door holding device without having to compromise the integrity of the door or adjacent wall by driving screws or other mounting devices into the door or adjacent wall. Furthermore, it would be advantageous to provide a door holding device that is mountable to an adjacent wall which will protect the integrity of the adjacent wall from damage when the door is quickly or forcibly opened. Additionally, it would be advantageous to provide a door holding device which is mountable to an adjacent wall which has already been damaged by the door knob which will protect the adjacent wall from further damage and cover the previously damaged portion of the adjacent wall.

SUMMARY OF THE INVENTION

The present invention is a door holding device for stopping and holding a door in a releasably open position against an adjacent wall. In one embodiment of this invention, the door has a magnetically attractive door knob assembly mounted thereon. In another embodiment, the door has a door knob assembly containing magnetic means.

The holding device of the present invention comprises a mounting base mounted to the adjacent wall at a predetermined elevation substantially equal to the elevation of the door knob and attached to the outer wall surface without penetration or modification to the outer surface of the wall. Magnet means are secured to the mounting base for coacting with the door knob of the door, wherein upon the door opening from a nearly closed position to a point nearingly adjacent the adjacent wall, the magnet means coact with the door knob sufficient to stop the door knob and to hold the door in the releasably open position.

In an embodiment of the present invention, the mounting base has a recessed portion formed therein. Preferably, the magnet means is mounted within the recessed portion.

In an additional embodiment of the present invention, the holding device comprises the mounting base being constructed from a rigid durable material with cushioning means secured between the mounting base and the backing plate within the recessed portion. Preferably, the cushioning means has a mounting base side surface and a magnet means side surface and the mounting device further comprises an adhesive layer applied to at least the mounting base side surface and the magnet means side surface for securing the cushioning means between the mounting base and the magnet means. In another embodiment of the present invention, the mounting base is constructed from a resilient material. Preferably, the mounting base is secured to the adjacent wall means preferably by double-sided adhesive foam pads. However, any fastening means such as screws or nails may be used.

In yet another embodiment of the present invention, the holding device comprises a rigid backing receptacle mounted within the recessed portion between the mounting base and the magnet means.

In still another embodiment of the present invention, the holding device comprises a substantially cylindrical tube member frictionally mounted or preferably with adhesives within the recessed portion for receiving the magnet means and the cushioning means. Preferably, the tube member has a circumferential lip portion adjacent the magnet means for retaining the magnet means and cushioning means within the tube member.

The door may have, in a further embodiment, a door knob which acts as a magnet or has a magnet mounted therein; in which embodiment, the holding device would have a magnetically attractive mounting base mounted to the adjacent wall at our elevation substantially equal to the elevation of the door knob.

The present invention further includes a method for catching and holding a door in an open position against an adjacent wall. The door has a magnetically attractive door knob mounted thereon.

The method of the present invention comprises mounting a mounting base to the adjacent wall, forming a recessed portion in the mounting base, and mounting magnet means within the recessed portion of the mounting base for coacting with the door knob of the door, whereby upon the door opening from a closed position to a point nearingly adjacent the adjacent wall, the magnet means coact with the door knob thereby catching the door knob and holding the door in the open position.

In an embodiment of the present invention, the method comprises constructing the mounting base from a rigid durable material and securing cushioning means between the mounting base and the magnet means within the recessed portion. Preferably, the cushioning means has a mounting base side surface and a magnet means side surface and the method further comprises applying an adhesive layer to at least the mounting base side surface and the magnet means side surface for securing the cushioning means between the mounting base and the magnet means. In another embodiment of the present invention, the method comprises constructing the mounting base from a resilient material. Preferably, the mounting base is secured to the adjacent wall by a double-sided adhesive foam pad.

In yet another embodiment of the present invention, the method comprises providing a rigid backing receptacle mounted within the recessed portion between the mounting base and the magnet means.

Preferably, the magnet means comprises a permanent magnet. That is, a permanent magnet is one that retains a considerable amount of magnetism indefinitely. Permanent magnets may be made of hardened steel and its alloys and also in ceramic permanent magnetic materials. Certain resilient materials, such as rubberized materials, may hold or be constructed with permanent magnet wires. Permanent magnets are magnetized, typically, by placing them over a bus bar carrying a large direct current, by placing them across the poles of a powerful electromagnet, or by an ampere-turn pulse. Other known magnets, such as an electromagnet, may be used in the device and method of the present invention. A portative electromagnet may be particularly useful in this invention. Examples of permanent magnetic materials include 5% to 6% tungsten steel; 3½% chrome magnet steel; cobalt magnet steel containing 16% to 36% cobalt and 5% to 9% chromium and in some alloys tungsten; and the carbon-free aluminum-nickel-cobalt-steel alloys commonly called Alnico.

In a preferred embodiment of this invention, the magnet means comprises rubber which is magnetized multi-pole or on one side only. High energy rubber also can be magnetized by methods known in the art. Magnetized rubber is especially useful since such rubber can also be the cushion means for absorbing some of the shock of door handle closure against an adjacent wall. The effectiveness of the magnet means of this invention may be enhanced by the use of a rigid metallic, e.g. steel, backing plate substantially contiguous to the magnet means.

Furthermore, preferably, the magnet means are substantially annular having an aperture or hole formed therethrough for receiving a locking mechanism protruding from the door knob.

The various embodiments illustrated and described include lock means protruding from the door knob resulting in the need for the various components to be annular in order to accommodate the lock protrusion. If the door knob does not include lock means, those skilled in the art can construct the door holding device of this invention without the presence of annular, e.g. hole, configuration. According to the present invention, the use of a door knob assembly without a locking mechanism permits the use of magnet means in sheet or block form and permits the construction of the backing and cushion means plate from a solid sheet or block. Preferably, the magnet means is used in conjunction with a backing plate as previously described, but a backing plate can be eliminated from the device if desired by the user and still be within the scope of the present invention.

In still another embodiment of the present invention, the method comprises providing a substantially cylindrical tube member frictionally mounted within the recessed portion for receiving the magnet means and the cushioning means. Preferably, the tube member has a circumferential lip portion at one end thereof nearingly adjacent the magnet means for retaining the magnet means and cushioning means within the tube member.

In a still further embodiment of the present invention, the door stop and holding device comprises a door knob assembly, a magnetically attractive mounting base mounted to the adjacent wall at an elevation substantially equal to the elevation of the door knob and magnet means being a part of the door knob assembly wherein upon the door opening from a nearly closed position to a point immediately adjacent the adjacent wall, the magnet means coating with the mounting base sufficient to stop and hold the door in a releasably open position.

A further embodiment of the present invention, the mounting base has a recessed portion formed therein. In such further embodiment, preferably, cushioning means is adhesively mounted within the recessed portion.

A still further embodiment of the method of the present invention comprises mounting a magnetically attractive mounting base to an adjacent wall adjacent to the door when the door is in open position, forming a recessed portion in the mounting base, mounting a door knob assembly on the door, and mounting magnet means as a part of the door knob assembly for coacting with the mounting base, whereby upon the door opening from a nearly closed position to a point immediately adjacent the adjacent wall, the magnet means coating with the door knob assembly sufficient to stop and hold the door in a releasably open position.

Another embodiment of the present invention, the door stop and magnetic holding device comprises a magnetically attractive door knob assembly, and rubberized magnet means mounted to the adjacent wall at an elevation substantially equal to the elevation of the door knob assembly for coacting with the door knob, wherein upon the door opening from a nearly closed position to a point immediately adjacent the adjacent wall sufficient to stop and hold the door in a releasably open position.

Still another embodiment of the method of the present invention comprises installing a magnetically attractive door knob assembly on the door; and, mounting a rubberized magnet means to the adjacent wall at an elevation substantially equal to the elevation of the door knob assembly for coacting with the door knob assembly, whereby upon the door opening from a nearly closed position to a point immediately adjacent the adjacent wall the door is stopped and held in a releasably open position.

In a particular embodiment of this invention the rubberized magnet means acts as a cushion to receive the impact of door opening against the adjacent wall.

DETAILED DESCRIPTION OF THE PREFERRED EMBODIMENTS

Figure 1:
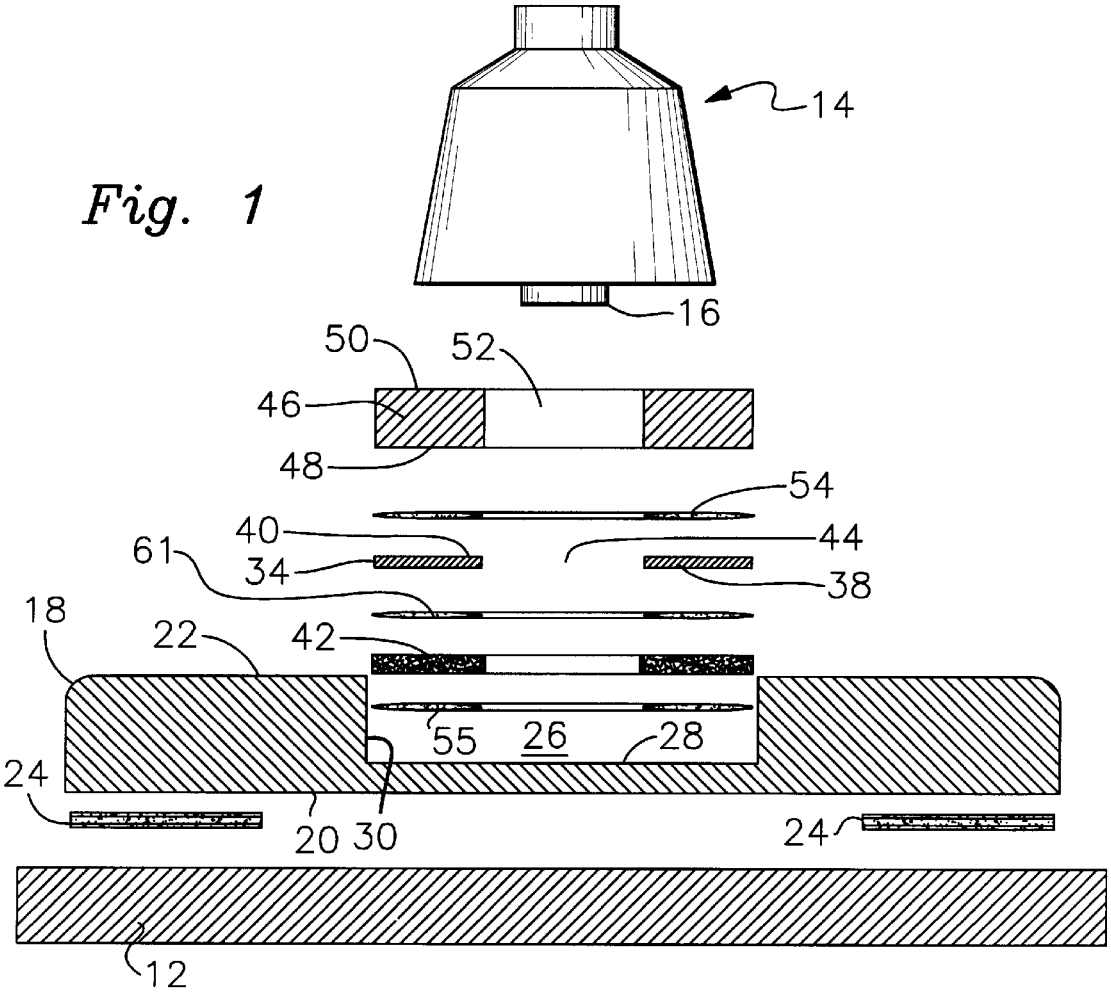
FIG. 1 is a sectional side view of an embodiment of the door knob holding device constructed according to the present invention.
Figure 2:
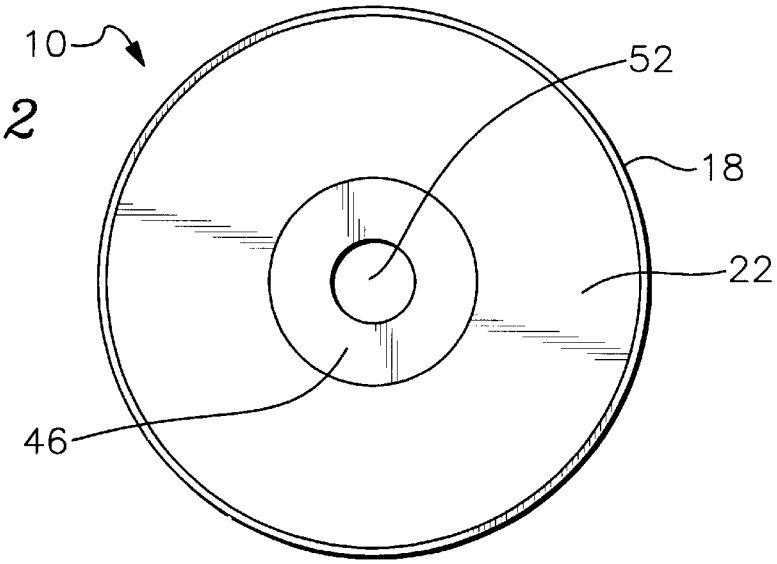
FIG. 2 is a front view of the embodiment as illustrated in FIG. 1 of the door knob holding device constructed according to the present invention.

As illustrated in FIG. 1 and FIG. 2, the present invention is a door knob holding device, indicated generally at 10, for stopping a door (not shown) prior to any portion of the door striking an adjacent wall 12 upon which the door opens and then catching and holding the door in an open position. While the door typically has a substantially circular door knob 14 with a locking mechanism 16 mounted substantially in the center of the door knob 14, the door knob holding device 10 of the present invention can be utilized with any type of magnetically attractive door knob 14 with or without a locking mechanism 16 mounted thereon. The door knob holding device 10 of the present invention inhibits damage to the adjacent wall 12 typically caused by the door knob 14 on the door striking the adjacent wall 12 by stopping the door knob 14 prior to contact with the adjacent wall 12 and maintaining the door in the open position until closure of the door is desired by the user. Furthermore, as will be understood below, the holding device 10 can be easily installed over a previously damaged adjacent wall 12 and thereby cover and patch the adjacent wall 12 without further need for repair.

The door knob holding device 10 of the present invention comprises a mounting base 18 mountable to the adjacent wall 12 at approximately the same elevational height from the floor surface as the door knob assembly 14. The mounting base 18 has a first mounting side surface 20 and a second outer side surface 22 opposite the first mounting side surface 20. The first mounting side surface 20 is preferably substantially flat for easy and flush mounting against the adjacent wall 12 or other substantially stationary object such as a post. An adhesive substance, such as double-sided adhesive foam pads 24 with an adhesive layer on both sides, are positioned between the first mounting side surface 20 of the mounting base 18 and the adjacent wall 12. The adhesive foam pads 24 are secured to the adjacent wall 12 and the first mounting side surface 20 of the mounting base 18 is applied to the adhesive foam pad 24 thereby releasably securing the mounting base 18 to the adjacent wall 12. In practice, it is preferable to put pad 24 on the first mounting side surface 20 of mounting base 18 before putting the other side of the adhesive foam pad 24 on the adjacent wall 12. Other adhesive substances including, but not limited to glue, epoxy, double-sided tape, etc., are within the scope of the present invention.

The outer dimensions of the mounting base 18 are preferably greater than the outer dimensions of the door knob 14. By providing the mounting base 18 with outer dimensions greater that the door knob's outer dimensions, the mounting base 18 is suitable for completely covering the damage, if any, previously sustained by the adjacent wall 12 during an event when the door knob 14 contacted the adjacent wall 12 upon the quick and forceful opening of the door.

The mounting base 18 preferably has a substantially circular cross-sectional configuration and is preferably constructed from a durable material such as wood, plastic, metal, molded material, etc. While the mounting base 18 has been described as having a circular cross-sectional configuration, other cross-sectional or decorative configurations including, but not limited to, square, rectangular, hexagonal, artistic scenes, etc., are within the scope of the present invention. Furthermore, while the mounting base 18 has been described as being constructed from the durable materials listed above, other durable materials including, but not limited to, ceramic, fiber, rubber, etc., are within the scope of the present invention.

Preferably, the mounting base 18 has a substantially circular recessed portion 26 substantially centrally formed in the second outer side surface 22 extending from the second outer side surface 22 into the mounting base 18 without attaining the first mounting side surface 20. Recessed portion 26 is described as preferably being of circular configuration but any other configuration, such as square, rectangular, oval, etc. may be used. It is only necessary that the recessed portion 26 be able to accept the configuration of the door knob assembly 14. The recessed portion 26 has a first receiving surface 28 substantially parallel to the first mounting side surface 20 of the mounting base 18 and an annular side wall 30 substantially perpendicular to the first receiving surface 28.

The holding device 10 of the present invention further comprises a relatively rigid backing plate 34, i.e., steel plate, mounted within portion 26 of mounting base 18 for absorbing the shock of door knob 14 being forcibly moved to the adjacent wall 12 and hitting the mounting base 18 with some force. The backing plate 34, preferably, is a substantially flat, annular circulate plate having an aperture or hole 44 therethrough. The backing plate 34 has a first side surface 38 and a second side surface 40 substantially opposite the first side surface 38.

An annular cushioning member 42 is affixed to the first receiving surface 28 of the recessed portion 26 by an adhesive substance 55 or other means, i.e., a double-sided adhesive foam pad. The first side surface 38 of the backing plate 34 is applied to the cushioning member 42 and secured thereto by an adhesive substance 61. The cushioning member 42 provides protection for the door knob 14 in case of the door opening toward the adjacent wall 12 is in a quick or forceful manner. Furthermore, while the cushioning member 42 heretofore has been described as being annular, it is within the scope of the present invention to have a cushioning member which is not annular.

The holding device 10 of the present invention also comprises an annular magnet means 46 having a first magnet side surface 48, a second magnet side surface 50 opposite and substantially parallel to the first magnet side surface 48, and an aperture 52 extending through the magnet 46 from the first magnet side surface 48 to and through the second magnet side surface 50. The magnet 46 is sized to be received within the annular side wall 30 of the mounting base 18. Adhesive 54 is positioned between the first magnet side surface 48 and the second side surface 40 of the backing plate 34 to secure the magnet 46 to backing plate 34. The annular configuration of the magnet 46 with the magnet aperture 52 therethrough provides the locking mechanism 16, if any, of the door knob 14 to be received within the magnet aperture 52 of the magnet 46 when the door is secured and held in the open position.

Figure 3:
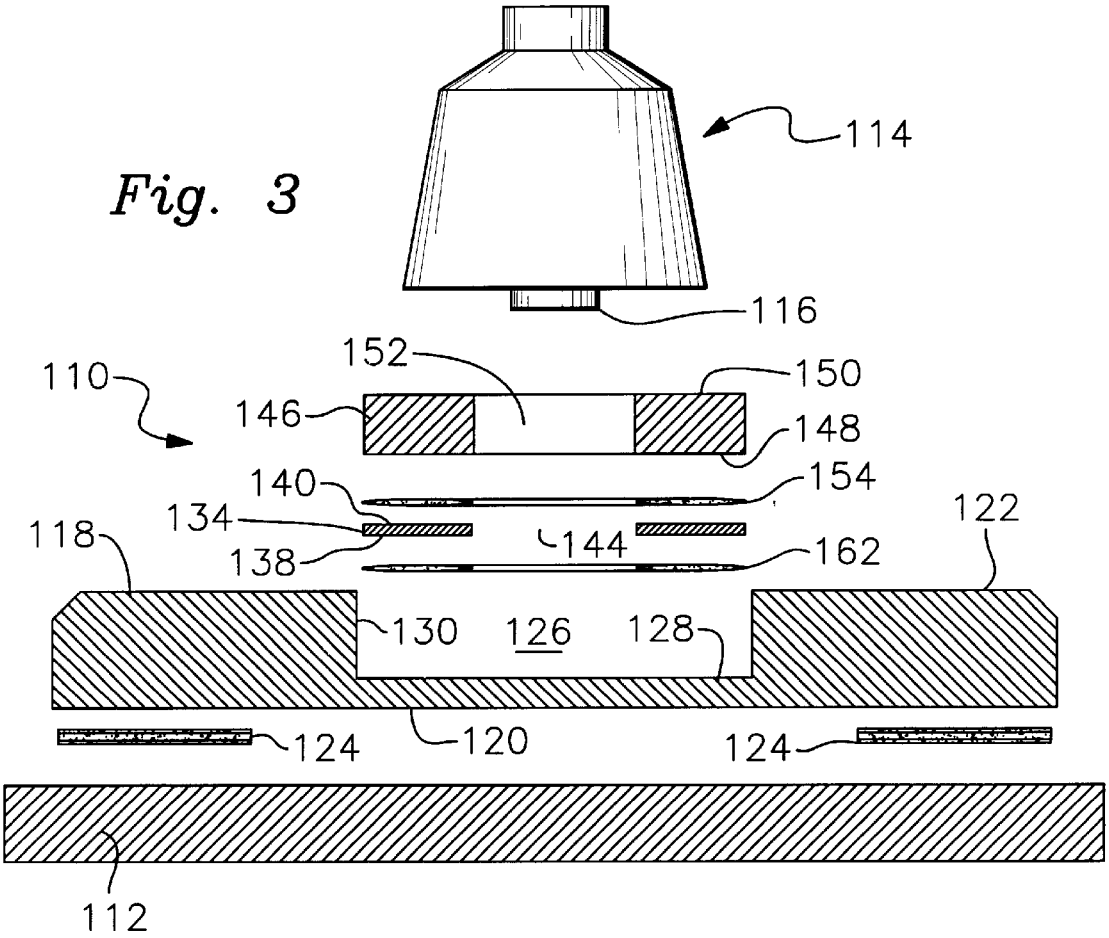
FIG. 3 is a sectional side view of another embodiment of the door knob holding device constructed according to the present invention.
Figure 4:
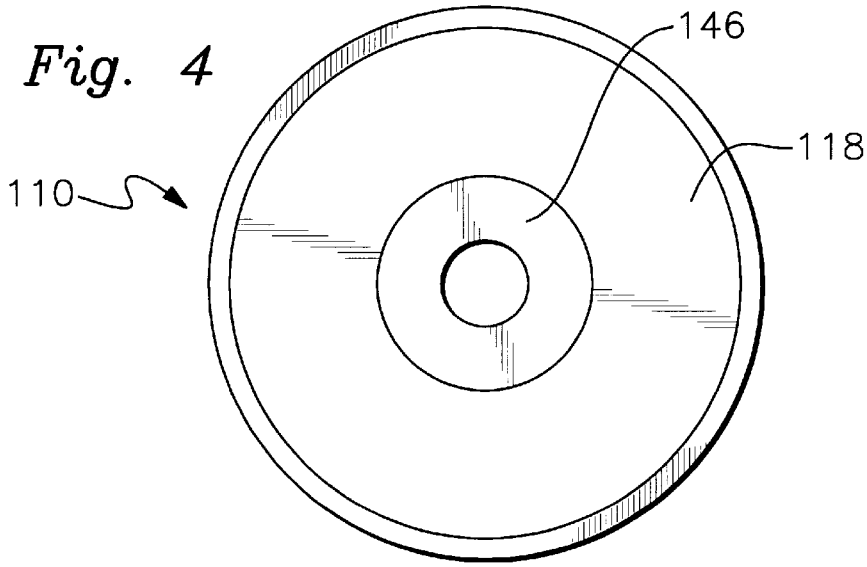
FIG. 4 is a front view of the embodiment as illustrated in FIG. 3 of the door knob holding device constructed according to the present invention.

As illustrated in FIGS. 3 and 4, the holding device 110 is substantially similar to the holding device 10 as described above. However, the magnet means 146 of the holding device 110 is mounted directly within the recessed portion 126 without a cushioning member. The backing plate 134 is adhesively affixed between the magnet 146 and the first receiving surface 128 of the recessed portion 126 and the first magnet side surface 148 of the magnet 146.

Figure 5:
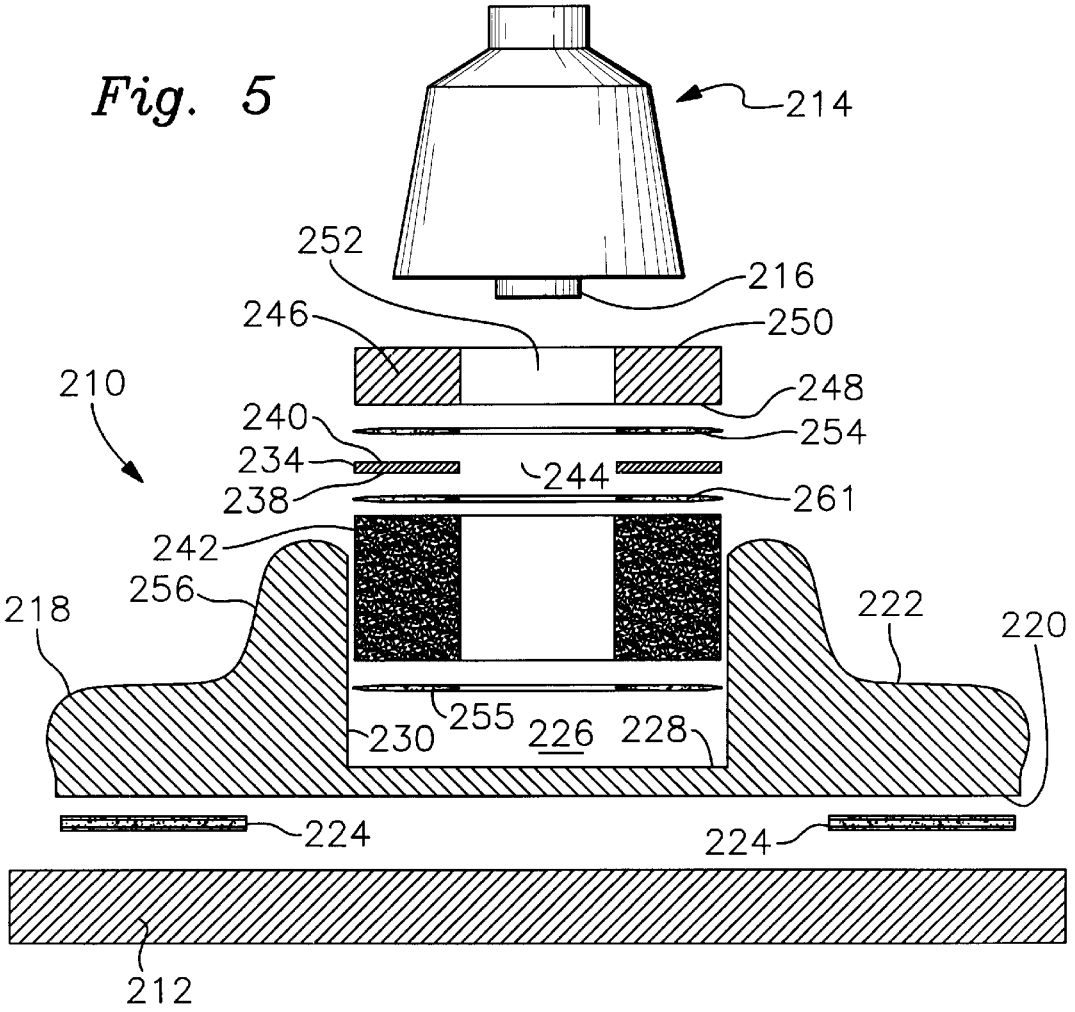
FIG. 5 is a sectional side view of a further embodiment of the door knob holding device constructed according to the present invention.
Figure 6:
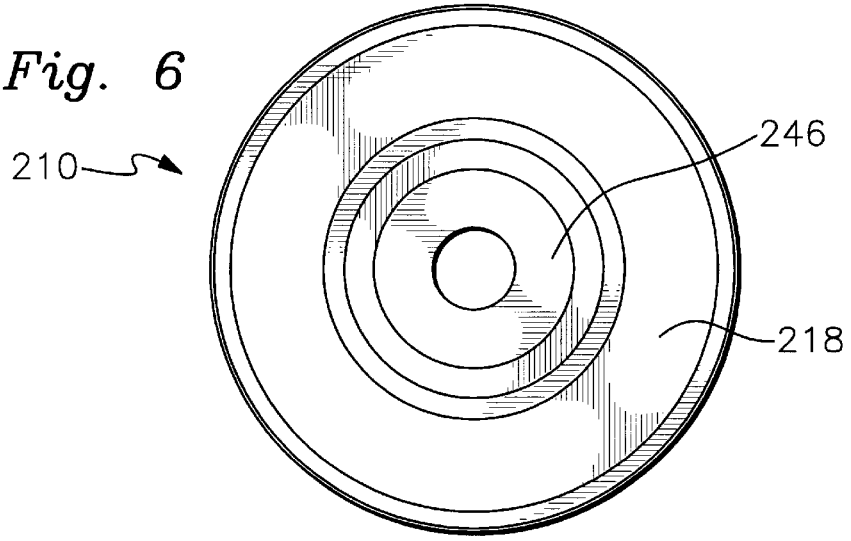
FIG. 6 is a front view of the embodiment as illustrated in FIG. 5 of the door knob holding device constructed according to thy present invention.

As illustrated in FIGS. 5 and 6, the holding device 210 is substantially similar to the holding device 10 as described above. The holding device 210 further comprises an annular lip portion 256 formed in the second outer side surface 222 of the mounting base 218 about the perimeter of the recessed portion 226. The annular lip portion 256 increases the length of the annular side wall 230 of the recessed portion 226 such that additional cushioning material for the cushioning member 242, if desired, can be provided between the backing plate 234 and the first receiving surface 228 of the recessed portion 226.

Figure 7:
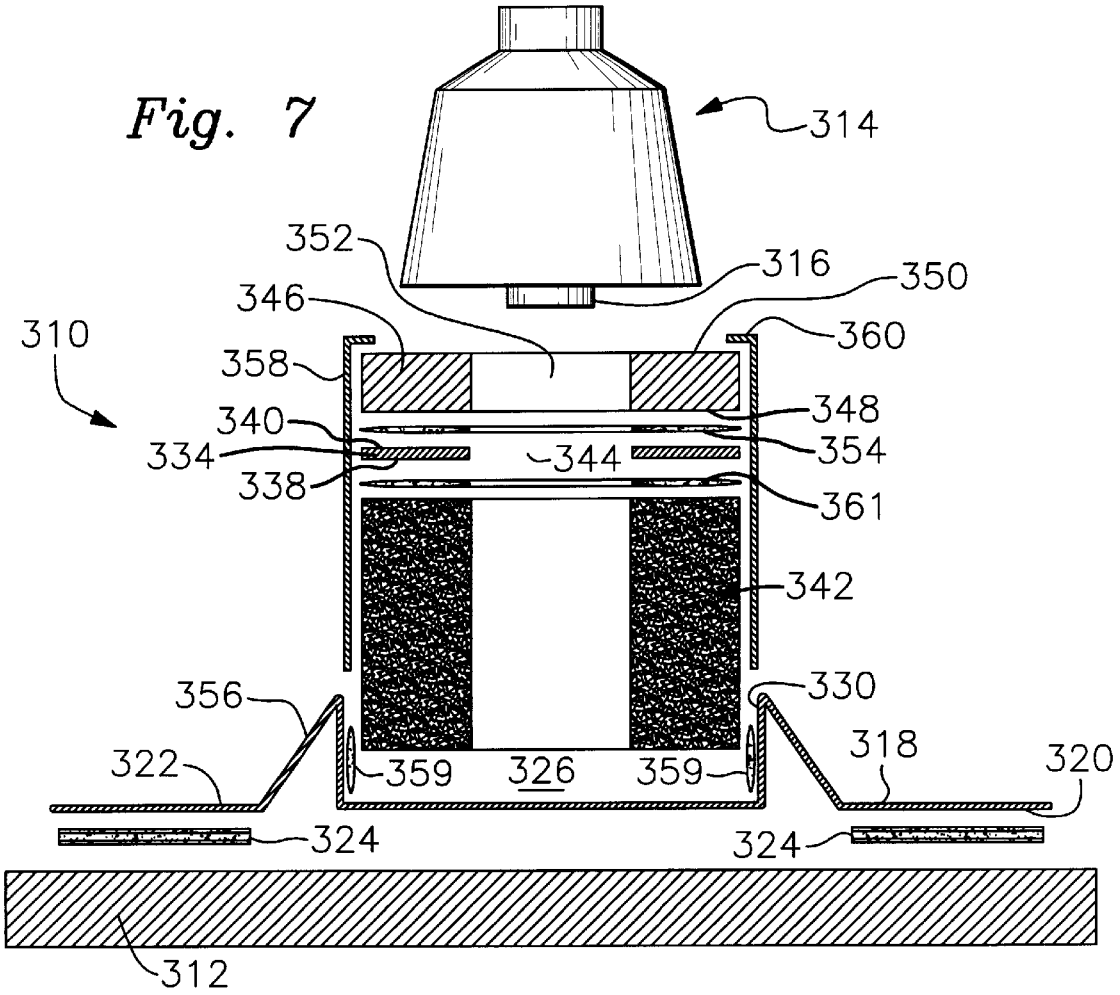
FIG. 7 is a sectional side view of still another embodiment of the door knob holding device constructed according to the present invention.
Figure 8:
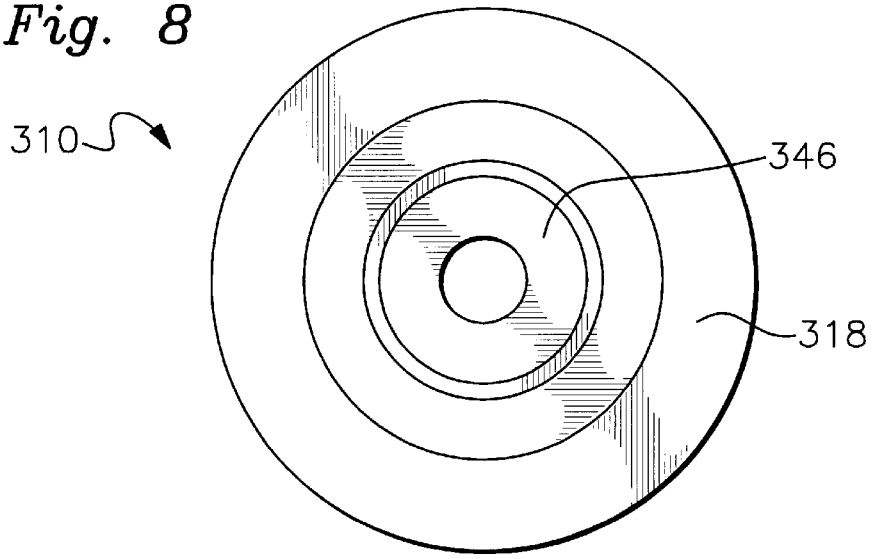
FIG. 8 is a front view of the embodiment as illustrated in FIG. 7 of the door knob holding device constructed according to the present invention.

As illustrated in FIGS. 7 and 8, the holding device 310 comprises the mounting base 318 being constructed from a flat piece of rigid material such as plastic, metal, or the like with an annular lip portion 356 formed in the second outer side surface 322 of the mounting base 318 about the perimeter of the recessed portion 326, similar to the holding device 210 as described above. Furthermore, the holding device 310 comprises a cylindrical tube component 358 frictionally mounted within the recessed portion 326 and extending above the annular lip portion 356. The tube component 358 provides placement of additional cushioning material for the cushioning member 342, if desired, as described above. An annular lip member 360 about the perimeter of the tube component 358 nearingly adjacent the magnet 346 maintains the magnet 346 the backing plate 334 and the cushioning member 342 within the tube component 358.

Figure 9:
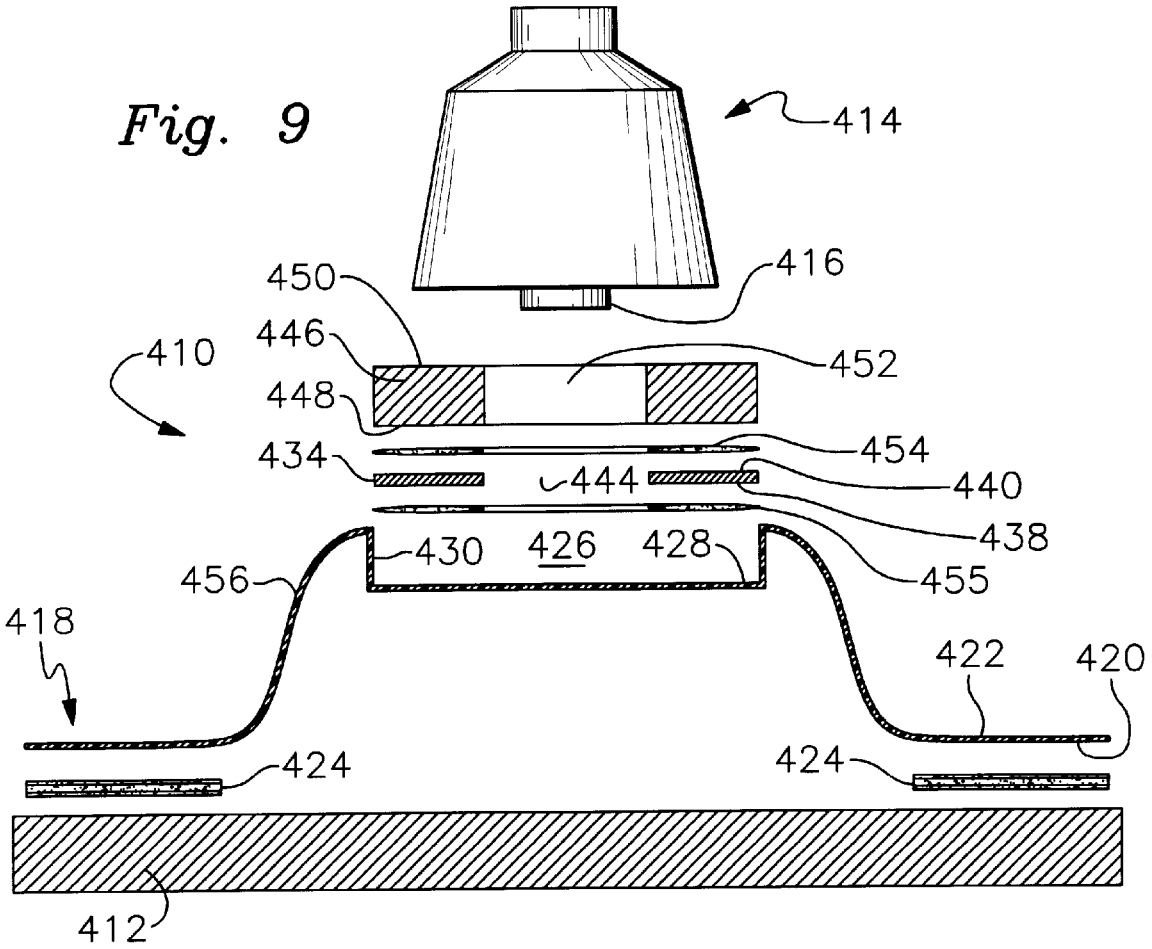
FIG. 9 is a sectional side view of yet another embodiment, of the door knob holding device constructed according to thy present invention.
Figure 10:
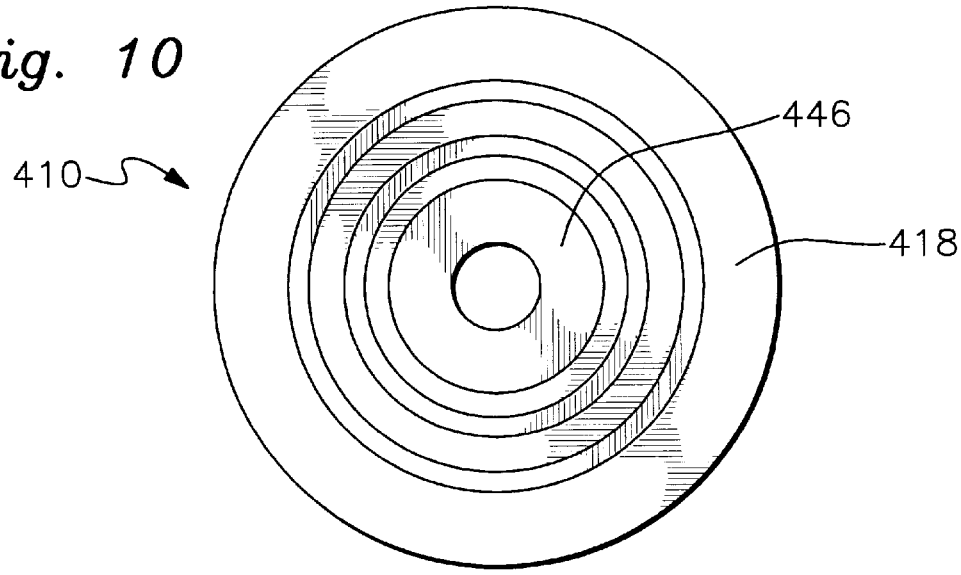
FIG. 10 is a front view of the embodiment as illustrates in FIG. 9 of the door knob holding device constructed according to the present invention.

As illustrated in FIGS. 9 and 10, the holding device of the present invention, indicated generally at 410, is similar to the holding device 210 as described above except that the mounting base 418 comprises a flexible, resilient material, i.e., rubber, rather than a rigid material as described above. By using a flexible resilient material for the mounting base 418, a cushioning member is no longer necessary to cushion the door knob 414 upon the door knob 414 striking the holding device 410.

Figure 11:
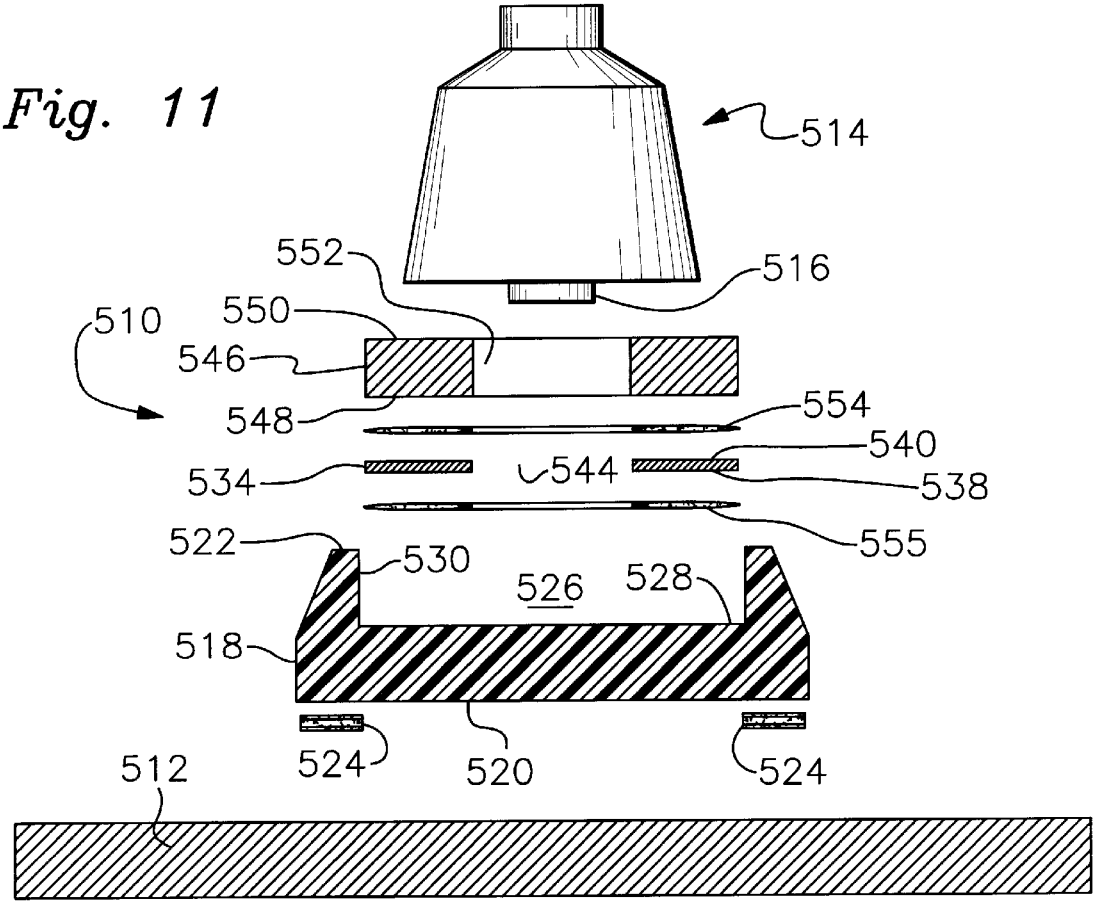
FIG. 11 is a sectional side view of a further embodiment the door knob holding device invention wherein the magnet mean is the door knob itself.
Figure 12:
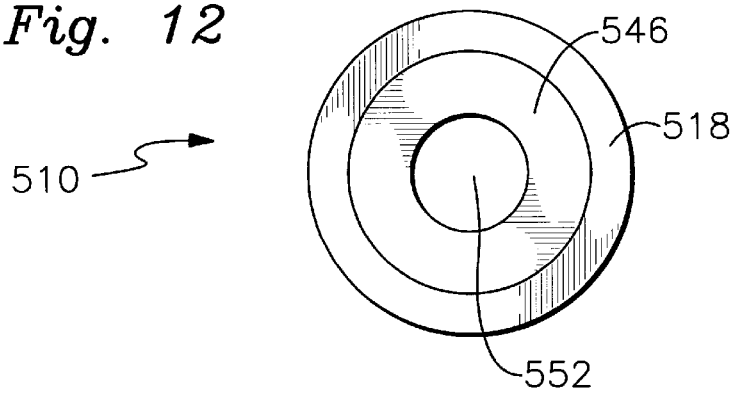
FIG. 12 is a front view of the embodiment as illustrated in FIG. 11 of the door knob holding device constructed according to the present invention.

Referring to FIGS. 11 and 12, a still further embodiment of the door stop and magnetic holding device of this invention, indicated generally at 510, is similar to holding device 410 which does use separate cushioning means, and comprises a mounting base 518 which comprises a flexible, resilient material mountable to the adjacent wall 512 at an elevation at approximately the same elevational height from the floor surface as the door knob assembly 514. The mounting base 518 has a first mounting side surface 520 and a second outer side surface 522 opposite the first side surface 520 and facing door knob assembly 514 when assembly 514 is in a releasably open position. The first mounting side surface 520 is preferably substantially flat for easy and flush mounting against the adjacent wall 512 or other substantially stationary object, such as a post. An adhesive substance such as double-sided adhesive foam pads 524 with an adhesive layer on both sides, is positioned between the first mounting side surface 520 of the mounting base 518 and adjacent wall 512. The adhesive foam pads 524 are secured to the adjacent surface 512 and the first mounting side surface 520, and the mounting base 518 is applied to the adhesive foam pads 524 thereby releasably securing the mounting base 518 to the adjacent wall or surface 512.

Preferably, the mounting base 518 has a substantially circular recessed portion 526 substantially centrally formed in the second outer side surface 522 extending from the second outer side surface 522 into the mounting base 518 without attaining the first mounting side surface 520. Recessed portion 526 is described as preferably being of circular configuration but any other configuration, such as square, rectangular, oval, etc. may be used. It is only necessary that the recessed portion 526 be able to accept the configuration of the door knob assembly 514. The recessed portion 526 has a first receiving surface 528 substantially parallel to the first mounting side surface 520 of the mounting base 518 and an annular side wall 530 substantially perpendicular to the first receiving surface 528.

Figure 13:
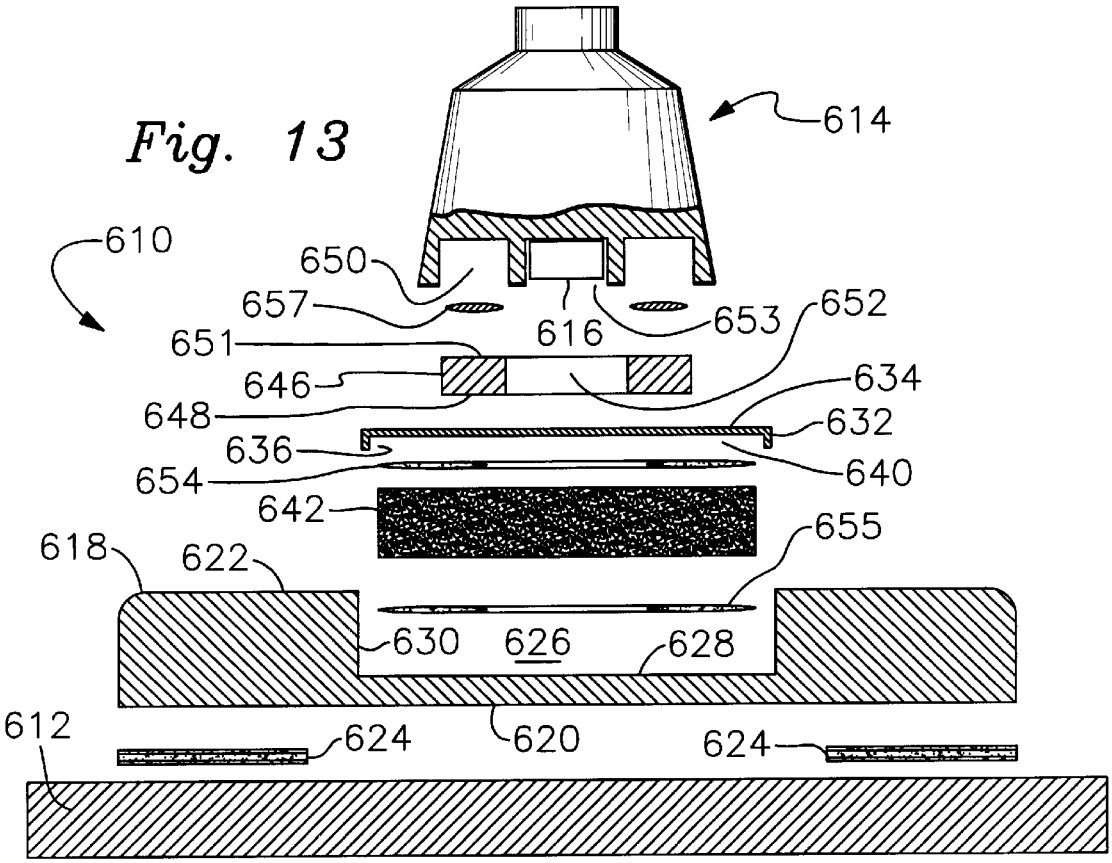
FIG. 13 is a sectional view of the door knob holding device constructed according to the present invention wherein the magnet means is located within the door knob itself.
Figure 14:
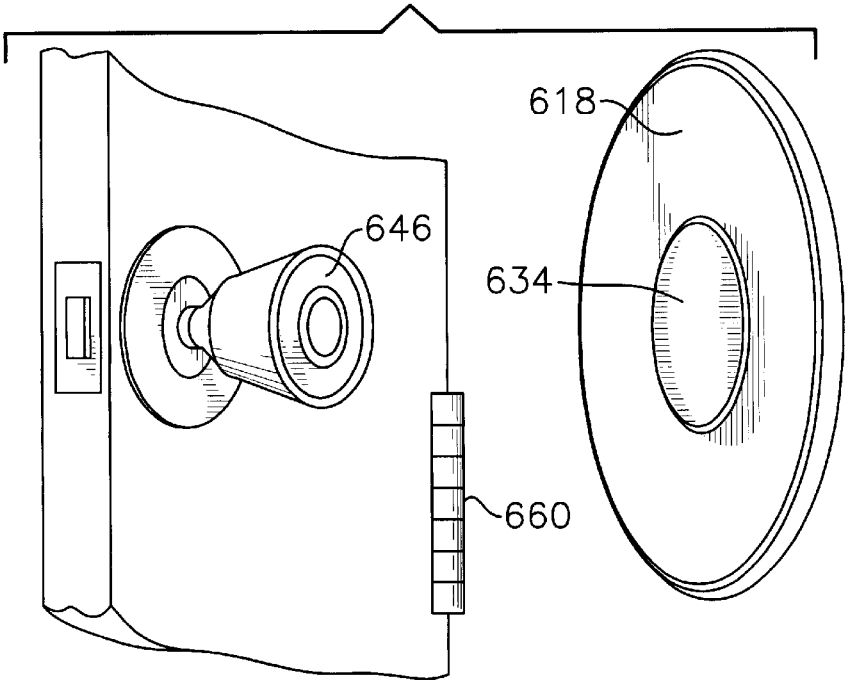
FIG. 14 is a schematic front view of the embodiment as illustrated in FIG. 13 of the door holding device constructed according to the present invention.

As illustrated in FIGS. 13 and 14, the present invention is a door stop and magnetic holding device, indicted generally at 610, for stopping a door (not shown) being supported generally by door hinge 660, prior to any portion of the door striking and adjacent wall 612 upon which the door swings on hinge 660 to an open position and then to stop and hold or catch the door in a releasably open position. While the door typically has a substantially circular door knob 614 with a locking mechanism 616 mounted substantially in the center of door knob assembly 614, the door stop and holding device 610 of the present invention can be utilized with any type of door knob assembly 614 which is a magnet or contains magnet means with or without a locking mechanism 616 mounted therein.

The holding device 610 of this embodiment of the present invention further comprises cushioning member 642 affixed to the first receiving surface 628 of the recessed portion 626 of base member 618 by adhesive means 655 which may be a double-sided adhesive foam pad. The cushioning member 642 provides protection for the door knob 614 in case the door opening toward the adjacent wall 612 is in a quick or forceful manner.

The holding device 610 of this embodiment further comprises a rigid backing receptacle 632 which is adhesively attached to cushioning means 642 by means of adhesive means 654 which affixes to surface 640 of receptacle 632. The backing receptacle 632 comprises a substantially flat, circular base plate 634 and annular side wall 636 surrounding and substantially perpendicular to surface 640. Rigid backing receptacle 632 is preferably of unitary configuration, but the annular side wall 636 can be eliminated whereupon receptacle 632 becomes a rigid magnetically attractive backing or strike plate 634 absorbing the shock of door knob 614 being forcibly moved to the adjacent wall 612 and hitting the mounting base 618 with some force.

The holding device 610 of the present invention also comprises a door knob assembly 614 having magnet means 646 as part of assembly 614. Magnet means 646 preferably may be mounted in recessed portion 650 as a circular unitary permanent magnet which may be affixed in recess 650 by adhesive means 657.

Figure 15:
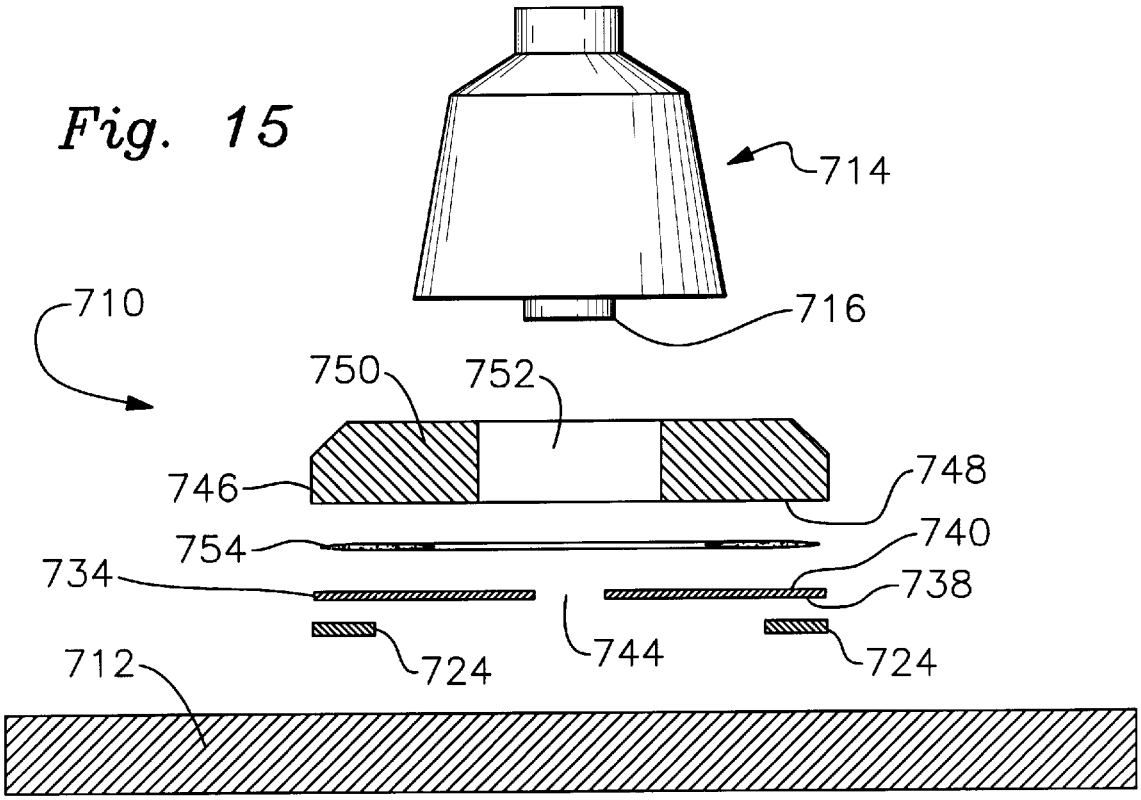
FIG. 15 is a sectional view of still another embodiment of the door knob holding device constructed according to the present invention wherein the cushioning means is also magnet means.
Figure 16:
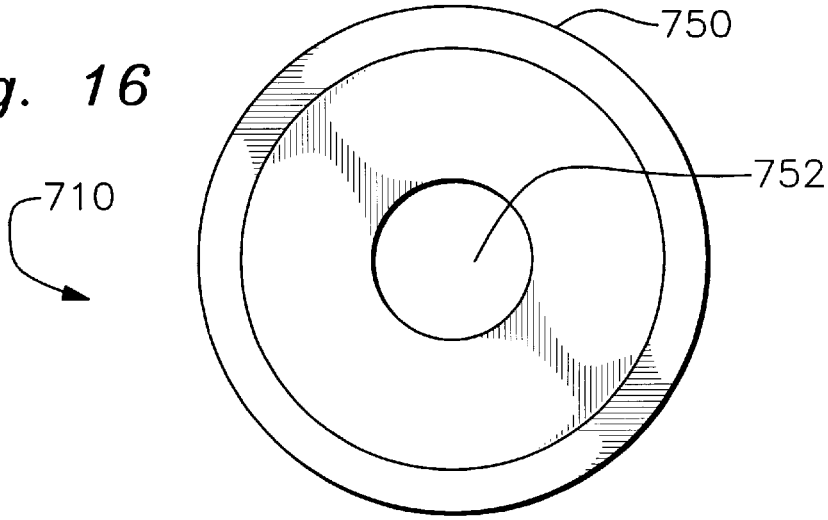
FIG. 16 is a front view of the embodiment as illustrated in FIG. 15 of the door holding device constructed according to the present invention.

As particularly illustrated in FIGS. 15 and 16, the door stop and holding device of the present invention, indicated generally at 710, comprises an annular rigid backing plate 734, which is attached to the wall or other substantially stationary object 712, such as by means of adhesive pads 724 which also attach to surface 738 of plate 734. The backing plate 734 has an aperture or hole 744 which may accommodate the locking means 716 which protrudes from door knob assembly 714 at the point where door knob assembly 714 is stopped and held in a releasably open position against wall 712.

The backing plate 734 has a first mounting surface 738 and a second outer surface 740 opposite the first side surface 738 and facing door knob assembly 714 when assembly 714 is in a releasably open position. The first mounting surface 738 is preferably substantially flat for easy and flush mounting against the adjacent wall 712 or other substantially stationary object, such as a post. An adhesive means 724, such as double-sided foam pads with an adhesive layer on both sides of the pads, is positioned between the first mounting side surface 738 of the backing plate 734 and adjacent wall 712. The adhesive foam pads 724 are secured to the adjacent surface 712 and the first mounting side surface 738, and the backing plate 734 is applied to the adhesive foam pads 724 thereby releasably securing the backing plate 724 to the adjacent wall or surface 712. This embodiment of the invention has rubberized magnet means, 746, such as high energy rubber which is attached to backing plate 734 by means of adhesive means 754. The magnet means 746 has an aperture or hole 752 which accommodates the locking means 716 which protrudes from door lock assembly 714 as described. The use of a rubberized magnet means permits the elimination of other cushioning means for the door stop and locking device of this invention. The rubberized magnet means 746 has a mounting surface 748 facing the backing plate 734. The mounting surface 748 is preferably substantially flat for easy and flush mounting against backing plate 734. An adhesive means 754, such as glue or double-sided foam gasket-type material with an adhesive layer on both sides of such material, is positioned between the mounting surface 748 and surface 740 of the backing plate. The adhesive means 754 is secured to surface 740 and the mounting surface 748 is applied to adhesive means 754 thereby securing the rubberized magnet means 746 to the backing plate 734.

The door knob holding device of the present invention combines many beneficial features useful in homes and business environments. The door knob holding device is basically a door bumper, a wall patch, and a wall protector device. Furthermore, the door knob holding device is a holding device which catches and holds the door in an open position while neither requiring mounting screws, bolts, or other fastening mechanisms which often destroy the integrity and aesthetic beauty of the door and the adjacent wall nor requiring any portion of the holding device to be mounted to the door itself. In fact, since the only portion of the door knob holding device of the present invention is mounted to the adjacent wall and not the door, mounting of the door knob holding device is extremely simple requiring fewer materials to construct the door knob holding device and additional mounting tools are not generally necessary.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A door stop and magnetic holding device comprising, in combination:

a magnetically attractive door knob assembly mounted at a predetermined elevation on a door;

a substantially flat outer surface of a wall adjacent to the door, the door being adapted to open toward said adjacent wall;

a mounting base with a substantially flat first mounting side, the mounting base flat first mounting side being contiguous to and adhesively secured with a double-sided foam pad to the substantially flat outer surface of the adjacent wall at an elevation substantially equal to the elevation of a magnetically attractive door knob and aligned to cooperatively engage said magnetically attractive door knob, said mounting base being attached without penetration or modification to the outer surface of the adjacent wall;

the mounting base further having a recessed portion formed therein, an inside diameter of the recessed portion being sized to proximate an outside diameter of the door knob; and magnet means adhesively secured within the mounting base recessed portion for coacting with and releasably engaging the magnetically attractive door knob of the door when the door is opened to a point nearingly adjacent the adjacent wall.

2. The device as claimed in claim 1 wherein the mounting base is constructed from a rigid durable material.

3. The device as claimed in claim 1 further comprising cushioning means secured between the mounting base and the magnet means within the recessed portion.

4. The device as claimed in claim 1 wherein the mounting base is constructed from a resilient material.

5. The device as claimed in claim 1 further comprising a rigid backing plate adhesively mounted within the recessed portion of the mounting base between the mounting base and the magnet means.

6. The device as claimed in claim 1 wherein the magnet means comprises a permanent magnet.

7. The device as claimed in claim 1 wherein the magnet means is substantially annular having an aperture formed therethrough for receiving a locking mechanism protruding from the door knob.

8. The device as claimed in claim 3 further comprising:

a substantially cylindrical hollow tube member frictionally mounted within the recessed portion for receiving the magnet means and the cushioning means; and the tube member having a circumferential lip portion adjacent the magnet means for retaining the magnet means and cushioning means within the tube member.

9. A door stop and door knob magnetic holding device comprising:

a door knob assembly mounted at a predetermined elevation on a door;

a substantially flat outer surface of a wall adjacent to the door, the door being adapted to open toward said adjacent wall;

a magnetically attractive mounting base with a substantially flat first mounting side, the mounting base flat first mounting side being contiguous to and adhesively secured with a double-sided foam pad to the substantially flat outer surface of the adjacent wall at an elevation substantially equal to the elevation of the door knob and aligned to cooperatively engage said door knob, said mounting base being attached without penetration or modification of the outer surface of the adjacent wall;

the mounting base further having a recessed portion formed therein, an inside diameter of the recessed portion being sized to proximate an outside diameter of the door knob; and magnet means being mounted to a part of the door knob assembly for coacting with and releasably engaging the magnetically attractive mounting base when the door is opened to a point immediately adjacent the adjacent wall.

10. The device as claimed in claim 9 wherein the mounting base is constructed from a rigid durable material.

11. The device as claimed in claim 9 further comprising cushioning means adhesively secured in the recessed portion of the mounting base.

12. The device as claimed in claim 11 further comprising a rigid strike plate mounted on the door knob side surface of the cushioning means.

13. The device as claimed in claim 9 wherein the magnet means comprises a permanent magnet.

14. A door stop and magnetic holding device comprising, in combination:

a magnetically attractive door knob assembly mounted at a predetermined elevation on a door;

a substantially flat outer surface of a wall adjacent to the door, the door being adapted to open toward said adjacent wall;

a mounting base with a substantially flat first mounting side, the mounting base flat first mounting side being contiguous to and adhesively secured with a double-sided foam pad to the substantially flat outer surface of the adjacent wall at an elevation substantially equal to the elevation of a magnetically attractive door knob and aligned to cooperatively engage said magnetically attractive door knob, the mounting base being made from a rubberized magnet material for coacting with and releasably engaging the magnetically attractive door knob wherein the rubberized magnet mounting base is substantially annular having an aperture formed therethrough or a recess therein which receives a protruding locking mechanism of the door knob when the door is opened, said mounting base being attached without penetration and modification of the outer surface of the adjacent wall.

15. The device as claimed in claim 14 further comprising a backing plate adhesively secured between the adjacent wall and rubberized magnet mounting base.

* * * * *